US010507518B2

(12) United States Patent
Merrill et al.

(10) Patent No.: US 10,507,518 B2
(45) Date of Patent: Dec. 17, 2019

(54) HYBRID COMPONENT WITH COOLING CHANNELS AND CORRESPONDING PROCESS

(71) Applicant: SIEMENS AKTIENGESELLSCHAFT, München (DE)

(72) Inventors: Gary B. Merrill, Orlando, FL (US); Nicholas F. Martin, Jr., York, SC (US)

( * ) Notice: Subject to any disclaimer, the term of this patent is extended or adjusted under 35 U.S.C. 154(b) by 0 days.

(21) Appl. No.: 16/073,482

(22) PCT Filed: Feb. 19, 2016

(86) PCT No.: PCT/US2016/018656

§ 371 (c)(1),
(2) Date: Jul. 27, 2018

(87) PCT Pub. No.: WO2017/142549

PCT Pub. Date: Aug. 24, 2017

(65) Prior Publication Data

US 2019/0030591 A1 Jan. 31, 2019

(51) Int. Cl.
*B22C 9/04* (2006.01)
*B22C 9/10* (2006.01)
(Continued)

(52) U.S. Cl.
CPC ..... *B22C 9/04* (2013.01); *B22C 7/02* (2013.01); *B22C 9/10* (2013.01); *B22D 29/002* (2013.01); *F01D 5/147* (2013.01); *F01D 5/187* (2013.01); *F01D 5/282* (2013.01); *F01D 5/284* (2013.01); *F01D 9/041* (2013.01); *F01D 25/12* (2013.01); *F05D 2220/32* (2013.01); *F05D 2230/21* (2013.01); *F05D 2260/20* (2013.01); *F05D 2260/221* (2013.01); *F05D 2300/175* (2013.01); *F05D 2300/20* (2013.01); *F05D 2300/5023* (2013.01); *F05D 2300/6012* (2013.01); *F05D 2300/6033* (2013.01)

(58) Field of Classification Search
CPC .... B22C 7/02; B22C 9/04; B22C 9/10; B22D 29/00; B22D 29/002
USPC ..... 164/34, 35, 45, 132, 369
See application file for complete search history.

(56) References Cited

U.S. PATENT DOCUMENTS 5,626,462 A 5/1997 Jackson et al.
2006/0263222 A1 11/2006 Vetters
(Continued)

FOREIGN PATENT DOCUMENTS

EP 1347151 A2 9/2003

OTHER PUBLICATIONS

PCT International Search Report and Written Opinion of International Searching Authority dated Oct. 31, 2016 corresponding to PCT International Application No. PCT/US2016/018656 filed Feb. 19, 2016.

*Primary Examiner* — Kevin P Kerns
(74) *Attorney, Agent, or Firm* — Cantor Colburn LLP

(57) ABSTRACT

A process for forming a component is provided. The process includes providing a cooling channel flow definition at least partially about a core including a ceramic matrix composite material. A metal material is cast about the core and the cooling channel flow definition to form an outer metal shell. In addition, a cooling channel is formed from the cooling channel flow definition in the component.

10 Claims, 4 Drawing Sheets

(51) Int. Cl.

| | |
|---|---|
| ***B22C 7/02*** | (2006.01) |
| ***B22D 29/00*** | (2006.01) |
| ***F01D 5/14*** | (2006.01) |
| ***F01D 5/18*** | (2006.01) |
| ***F01D 5/28*** | (2006.01) |
| ***F01D 9/04*** | (2006.01) |
| ***F01D 25/12*** | (2006.01) |

(56) References Cited

U.S. PATENT DOCUMENTS

| | | | | |
|---|---|---|---|---|
| 2008/0145234 | A1* | 6/2008 | Lee et al. ..... | B22C 9/103<br>416/96 R |
| 2012/0148769 | A1 | 6/2012 | Bunker et al. | |
| 2015/0050159 | A1 | 2/2015 | Caldeira et al. | |
| 2015/0118057 | A1* | 4/2015 | Lee et al. ..... | B22C 9/10<br>416/236 R |

* cited by examiner

100

HYBRID COMPONENT WITH COOLING CHANNELS AND CORRESPONDING PROCESS

This application is a National Stage Application of and claims priority to PCT/US2016/018656, filed Feb. 19, 2016, the entirety of which is hereby incorporated by reference.

FIELD

The present invention relates to high temperature components, and more particularly to hybrid components having internal cooling channel(s) formed therein, and to methods of manufacturing the same.

BACKGROUND

Gas turbines comprise a casing or cylinder for housing a compressor section, a combustion section, and a turbine section. A supply of air is compressed in the compressor section and directed into the combustion section. The compressed air enters the combustion inlet and is mixed with fuel. The air/fuel mixture is then combusted to produce high temperature and high pressure gas. This working gas then travels past the combustor transition and into the turbine section of the turbine.

The turbine section typically comprises rows of vanes which direct the working gas to the airfoil portions of the turbine blades. The working gas travels through the turbine section, causing the turbine blades to rotate, thereby turning the rotor. The rotor is also attached to the compressor section, thereby turning the compressor and also an electrical generator for producing electricity. High efficiency of a combustion turbine is achieved by heating the gas flowing through the combustion section to as high a temperature as is practical. The hot gas, however, may degrade the various metal turbine components, such as the combustor, transition ducts, vanes, ring segments and turbine blades that it passes when flowing through the turbine.

For this reason, strategies have been developed to protect such components from extreme temperatures such as the development and selection of high temperature materials able to withstand these extreme temperatures. For one, ceramic matrix composite (CMC) materials have been developed with a resistance to temperatures up 1200° C. CMC materials may include a ceramic or ceramic matrix, either of which may be reinforced with ceramic fibers. One issue with CMC materials, however, is that while CMC materials can survive temperatures in excess of 1200° C., they can only do so for limited time periods in a combustion environment without being cooled.

Cooling strategies have thus also been developed which may deliver a cooling fluid through the turbine component (e.g., blade, vane) in order to carry heat away from the component. For example, a cooling fluid may be flowed through an available inner volume of the component in order to provide adequate cooling to the component. It is appreciated that to provide sufficient cooling, the flow velocity of the cooling fluid must be at a sufficiently high flow velocity through the inner volume. Otherwise, the flow velocity may be too low to provide the desired cooling effects. However, such use of high volume of cooling fluid is not without detriment. Since the cooling fluid is not combusted or otherwise utilized to produce energy, the significant volume of cooling fluid used may result in significant material and operating costs for the associated gas turbine.

DETAILED DESCRIPTION

Aspects of the present invention provide a hybrid component comprising a core formed from a CMC material, an outer shell formed from a metal material, and at least one cooling channel formed between the CMC core and the outer metal shell. By providing the CMC core, a cooling air flow is forced radially outward from the core, thereby directing the flow where it produces the most useful work in cooling the outer metal shell. In addition, the core provides for a reduced internal flow volume and reduced required flow velocity of the cooling fluid there through, thereby significantly reducing cooling fluid requirements and associated costs. Further, the use of a CMC material at the core additionally improves cooling efficiency as the CMC material comprises a high heat capacity, and thus less cooling fluid is needed.

In accordance with another aspect, there is provided a process for forming a component. The process comprises:

providing a cooling channel flow definition at least partially about a core comprising a ceramic matrix composite material;

casting a metal material about the core and the cooling channel flow definition to form an outer metal shell; and forming a cooling channel from the cooling channel flow definition in the component.

Figure 1:
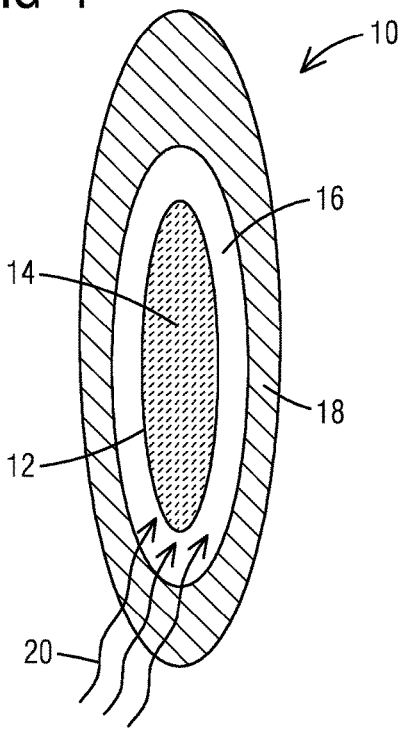
FIG. 1 illustrates a cross-section of a component comprising a CMC core and cooling channels formed therein in accordance with an aspect of the present invention.

Now referring to the FIGS., FIG. 1 illustrates a cross-section of a component 10 in accordance with an aspect of the present invention having an core 12 formed from a ceramic matrix composite material 14 (CMC core 12), one or more cooling channels 16 (cooling channel 16), and a metal shell 18 cast about the core 12 and the cooling channel 16. Thus, instead of a large internal volume through which a cooling fluid may flow, the CMC core 12 may force a cooling fluid introduced into the component into the cooling channel 16 between the CMC core 12 and metal outer shell 18. The narrower cooling fluid flow paths defined by the core 12 and cooling channel 16 may reduce cooling air requirements and increase cooling efficiency for the component 10, thereby substantially reducing material and operational needs.

Figure 18:
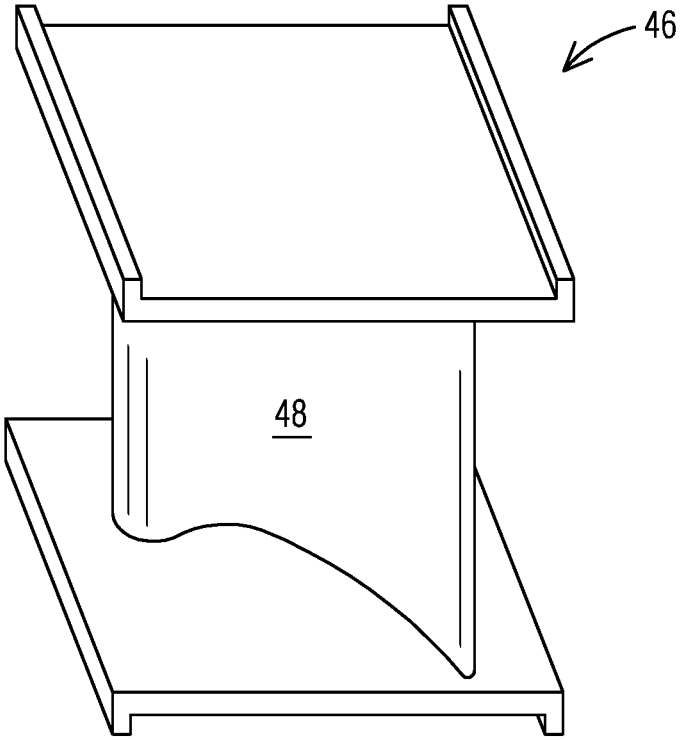
FIG. 18 illustrates a gas turbine vane having a CMC core, a metal shell, and internal cooling channels in accordance with an aspect of the present invention.

The component 10 may comprise any desired component, such as a gas turbine component as is known in the art. In a particular embodiment, the component 10 may comprise an airfoil configured for use in a combustor turbine hot gas section. For example, the component 10 may be a stationary part or a rotating part of a gas turbine, such as one of a transition duct, a blade, a vane, or the like. An exemplary turbine vane 46 is illustrated in FIG. 18. It is appreciated that the remaining FIGS. described and provided herein may represent a cross-section of the airfoil portion 48 of the vane 46 by way of example.

The ceramic matrix composite material 14 may comprise any suitable ceramic or ceramic matrix material that hosts a plurality of reinforcing fibers as is known in the art. In certain embodiments, the CMC material 14 may be anisotropic, at least in the sense that it can have different strength characteristics in different directions. It is appreciated that various factors, including material selection and fiber orientation, can affect the strength characteristics of a CMC material. In addition, the CMC material 14 may comprise oxide as well as non-oxide CMC materials. In an embodiment, the CMC material 14 comprises an oxide-oxide CMC material as is known in the art.

The fibers may be provided in various forms such as a woven fabric, blankets, unidirectional tapes, and mats. A variety of techniques are known in the art for making a CMC material and such techniques can be used in forming the CMC material 14 for use herein. In addition, exemplary CMC materials 14 are described in U.S. Pat. Nos. 8,058,191, 7,745,022, 7,153,096; 7,093,359; and 6,733,907, the entirety of each of which is hereby incorporated by reference. As mentioned, the selection of materials may not be the only factor which governs the properties of the CMC material 14 as the fiber direction may also influence the mechanical strength of the material, for example. As such, the fibers for the CMC material 14 may have any suitable orientation, such as those described in U.S. Pat. No. 7,153,096.

Forming the core 12 from a CMC material 14 may provide further advantages other than those already mentioned. For one, a CMC material 14 is substantially lighter than a metal material for the same volume, and thus may substantially reduce a weight of the component 10. In addition, to reiterate, the high heat capacity of CMC material 14 may lower the amount of cooling fluid required relative to a component with a metal core or the core removed. In certain aspects, the CMC core 12 may be formed into any shape, size, or dimension suitable for its intended purpose. In a particular embodiment, the CMC core 12 may comprise a substantially oval shape in cross-section, for example.

Each (one or more) cooling channel 16 provided in the component 10 may be of any suitable size, shape, and dimension (e.g., inner diameter) to provide a desired amount of cooling to the component 10 as would be appreciated by the skilled artisan. In addition, any suitable or desired number of cooling channels 16 may be provided in the component. Each cooling channel 16 may be provided in fluid communication with a suitable fluid source, such as an air compressor or the like (not shown), in order to flow the cooling fluid 20 through each cooling channel 16.

The outer metal shell 18 may be formed from any suitable metal material. In an embodiment, the metal material comprises a suitable alloy material, such as a superalloy material. For example, the superalloy material may comprise a Ni-based or a Co-based superalloy material as are well known in the art. The term "superalloy" may be understood to refer to a highly corrosion-resistant and oxidation-resistant alloy that exhibits excellent mechanical strength and resistance to creep even at high temperatures. Exemplary superalloy materials are commercially available and are sold under the trademarks and brand names Hastelloy™, Inconel™ alloys (e.g., IN 738, IN 792, IN 939), Rene™ alloys (e.g. Rene N5, Rene 41, Rene 80, Rene 108, Rene 142, Rene 220), Haynes™ alloys, Mar™ M, CM 247, CM 247 LC, C263, 718, X-750, ECY 768, 262, 20 X45, PWA 1483 and CMSX (e.g. CMSX-4) single crystal alloys, GTD 111, GTD 222, MGA 1400, MGA 2400, PSM 116, CMSX-8, CMSX-10, PWA 1484, IN 713C, Mar-M-200, PWA 1480, IN 100, IN 700, Udimet™ 600, Udimet™ 500 and titanium aluminide, for example The metal shell 18 and the CMC core 12 will generally have significantly different degrees of thermal expansion. Accordingly, in a hot gas environment, it would be expected that the expanding metal would structurally damage the CMC core 12 if the two components were allowed to directly contact/abut one another. For at least this reason, in accordance with one aspect, the CMC core 12 and the metal outer shell may be offset from one another utilizing any suitable structure or structural arrangement to avoid structural damage to the CMC core 12. In an embodiment shown in FIG. 1, the cooling channel 16 itself provides for a complete offset between the metal shell 18 and the CMC core 12. In other embodiments, a material or other structure may be disposed between the metal shell 18 and CMC core 12 at particular locations to avoid direct contact between metal with the CMC material.

Figure 2:
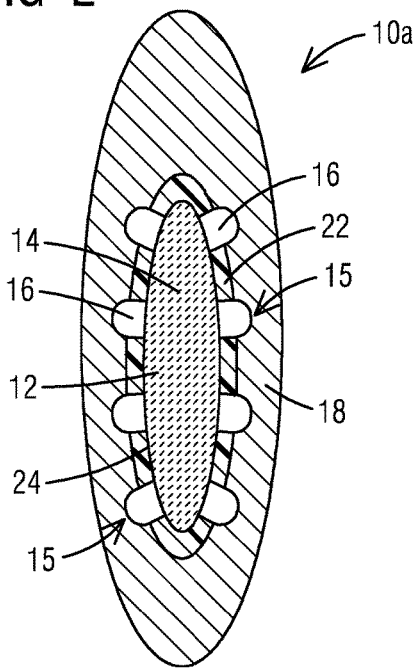
FIG. 2 illustrates a cross-section of a component comprising a CMC core and cooling channels formed therein in accordance with another aspect of the present invention.

For example, as shown in FIG. 2, there is provided a component 10*a* having a plurality of cooling channels 16 about the CMC core 12. Since the cooling channels 16 are spaced apart from one another, it would be appreciated that the cooling channels 16 would not entirely offset the CMC core 12 from the metal shell 18 when the metal shell 18 is cast. This would render the CMC core 12 susceptible to damage from the metal shell 18, particularly in operation in a hot gas environment where the metal material would be expected to expand and abrade the CMC core 12. To prevent this, a protective material 22 may be disposed between a perimeter 24 of the CMC core 12 and the metal shell 18 where desired or necessary. By way of example only, the protective material 22 may comprise wax, a polymer such as polystyrene, or any other suitable material which will act to protect the CMC core 12 from the metal shell 18.

Figure 3:
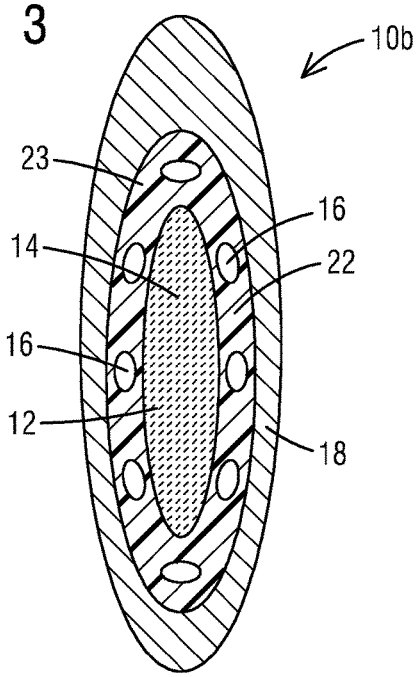
FIG. 3 illustrates a cross-section of a component comprising a CMC core and cooling channels formed therein in accordance with yet another aspect of the present invention.

In yet another embodiment, as shown in FIG. 3, there is shown a component 10*b*, wherein an amount of the protective material 22 may further be disposed between the CMC core 12 and the cooling channels 16 such that the cooling channels 16 are formed within a layer 23 (or ring) of the protective material 22.

In accordance with another aspect, there are provided processes for manufacturing the components (e.g., 10, 10*a*, 10*b*) as described herein having one or more cooling channels 16 encompassed by an outer metal shell 18. In one aspect, the processes described herein advantageously allow for the component to be manufactured in a final form in a single casting process instead of multi-step processes characterized by the prior art. Further, via use of the CMC core 12, issues with expansion of components and materials during the casting processes may be eliminated.

Figure 4:
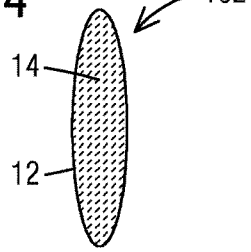

FIGS. 4-11 illustrate one process for manufacturing a component as described herein; however, it is understood that the present invention is not so limited to the described process. In one aspect, as shown in FIG. 4, the method 100 comprises step 102 of providing a CMC core 12 comprising a ceramic matrix composite (CMC) material 14 as described herein. The providing may include manufacturing the CMC material 14 and forming the core 12 therefrom into a desired dimension, as well as purchasing the CMC core 12 with a desired dimension from a commercially available source.

Figure 5:
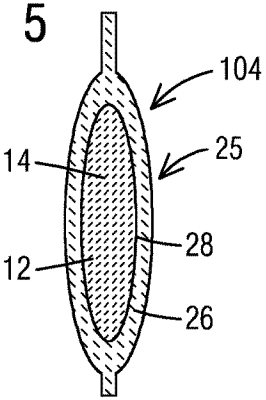

In a next step, the method 100 may further include step 104 of providing a cooling channel flow definition 25 at least partially about the CMC core 12 as shown in FIG. 5. By "cooling channel flow definition," it is meant a structure which when modified may produce the cooling channels 16 with a desired dimension. To accomplish this, in an embodiment, a channel defining material 26 may be deposited on at least a portion of an outer surface 28 of at least a portion of the CMC core 12. The channel defining material 26 may be applied in any suitable pattern which will ultimately define a corresponding cooling channel 16. For example, when a cooling channel 16 is desired about an entire perimeter of the CMC core 12 as was shown in FIG. 1, the channel defining material 26 may be applied about the entire perimeter of the CMC core 12 as is shown in FIG. 5. The channel defining material 26 may be deposited by any suitable deposition technique known in the art, such as by spraying onto a surface of the CMC core 12 and bonding to form a network or by casting onto the surface of the CMC core 12 using mold tooling or the like. Alternatively, a CMC core 12 with the channel defining defining material 26 disposed thereon may be provided in a pre-fabricated form.

In an embodiment, the channel defining material 26 may comprise a ceramic core material as is known in the art for forming passages in an article during casting of the article. Exemplary ceramic core materials may include a member selected from the group consisting of alumina, zircon, silica, and mixtures thereof. According to one aspect, the channel defining material 26, e.g., ceramic core material, may be designed to provide a stable matrix during the casting process such that the channel defining material 26 at least substantially keeps the shape in which it is deposited until at least a portion of the channel defining material 26 is removed to define the cooling channels 20. By way of example, the channel defining material 26 may be removed by a suitable leaching process or by a mechanical method.

When leaching is performed, suitable leach materials may include an alkaline solution as is known in the art for leaching or dissolving a corresponding ceramic material or materials. In an embodiment, when the ceramic core is silica or alumina-based, the leaching liquor may comprise a hydroxide having the formula MOH, wherein M is selected from the group consisting of sodium and potassium. In another embodiment, when the ceramic material comprises yttria, the leaching liquor may comprise an acid as its active component, such as nitric acid. In one aspect, during the removal process, the leaching liquor may be brought to a suitable temperature at or near (±10%) of its boiling point in order to remove the ceramic core material. Exemplary leaching processes are set forth in U.S. Pat. No. 5,332,023, the entirety of which is hereby incorporated by reference.

Figure 6:
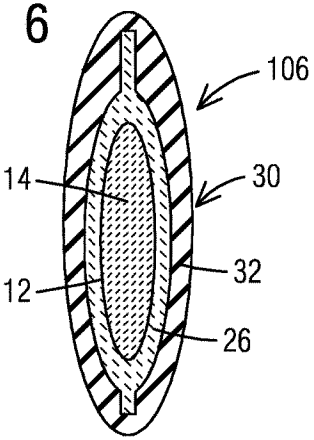

In a next step, the process 100 may further include step 106 of forming a wax region 30 about the CMC core 12 and the cooling channel flow definition 25, e.g., formed by channel defining material 26, as shown in FIG. 6. To form the wax region 30, an amount of wax 32 may be deposited about the CMC core 12 and the channel defining material 26 commensurate with the desired dimensions and volume of the metal shell 18 to be formed in a downstream process step. The wax 32 may be heated to a desired temperature to bring the wax 32 to a desired viscosity to flow into the desired region of the component 10, and then may be allowed to cool to form the wax region 30.

Figure 7:
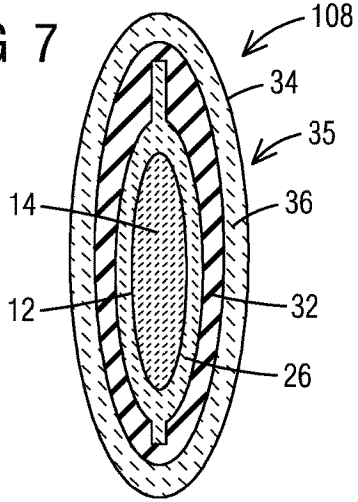
FIGS. 4-11 illustrate sequential steps of a process for forming a component in accordance with an aspect of the present invention.

In a next step, the process 100 may further include step 108 of forming an outermost shell 34 about the wax region 30 to form an intermediate component 35 as shown in FIG. 7. The outermost shell 34 may be formed from any suitable relatively rigid material, such as a ceramic material 36. Exemplary suitable ceramic materials 36 may comprise alumina and/or silica as are used in current shelling materials for investment casting. The ceramic material 36 and/or other suitable material may be deposited by any suitable method about the wax region 30. In an embodiment, the ceramic material 36 may be deposited after the wax region 30 is fully solidified in its desired dimension. In addition, the outermost shell 34 may have any desired uniform or variable thickness so as to form an outermost portion of the intermediate component 35. The purpose of the outermost shell 34 may be to maintain the desired shape of the component when the metal shell 18 is formed (as will be explained below).

Figure 8:
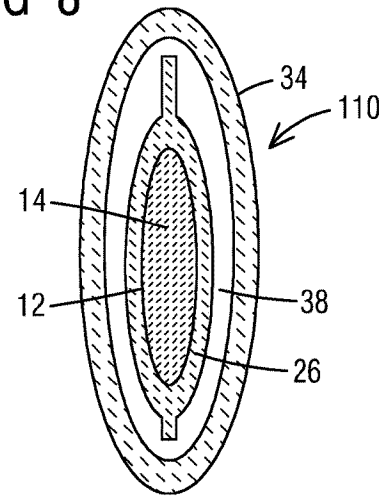

In a next step, the process 100 may further include step 110 of removing the wax region 30 to produce a void region 38 as shown in FIG. 8. As will be described below, the void region 38 may then be filled with a metal material 40 to form the metal shell 18. The removal of the wax region 30 may be accomplished by any suitable method, such as by applying heat to the wax region 30 and thereafter recovering the wax material.

Figure 9:
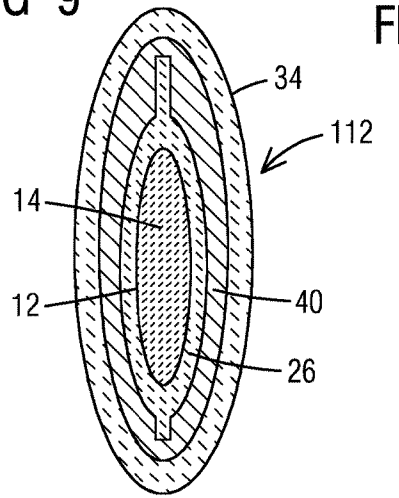

In a next step, the process 100 may further include step 112 of casting a metal material 40 in the void region 38 to form the metal shell 18, the metal shell 18 encompassing the channel defining material 26 and the CMC core 12 as shown in FIG. 9. In an embodiment, the metal material 40 may be provided in molten form and deposited about the CMC core 12 and channel defining material 26, and then allowed to cool in order to form the metal shell 18.

In a next step, the process 100 may further include step 114 of removing the outermost shell 34 to provide a final cast metal part. The outermost shell 34 may be removed by any suitable mechanical or chemical method, such as by agitation or the like.

Figure 11:
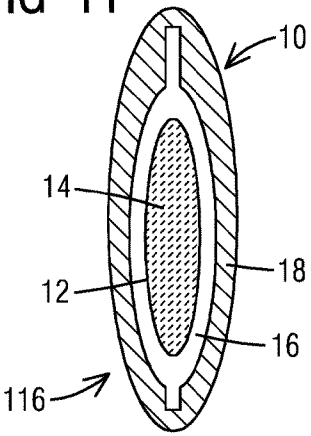
Figure 10:
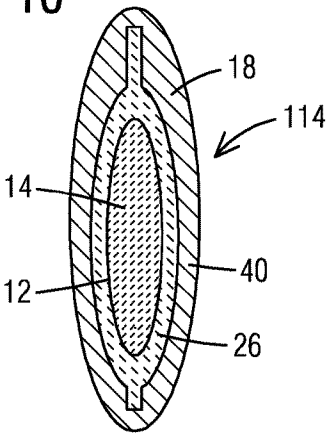

In a next step, the process 100 may further include step 116 of forming at least one cooling channel 16 from the cooling channel flow definition 25 as shown in FIG. 11. The channel flow definition 25 may be provided via depositing the channel defining material 26 in a desired pattern as explained previously. To then form one or more cooling channels 16 from the channel flow definition 25, in an embodiment, at least a portion of the channel defining material 26 may be removed by a suitable technique, such as leaching or the like, to define the cooling channel 16. Once the one or more cooling channels 16 have been formed, the now cast component 10 may be removed from its casting environment and delivered for further machining or polishing, if necessary or desired. In an embodiment, all of the material defining the cooling channels 26 is removed to form the cooling channel 16.

Figure 12:
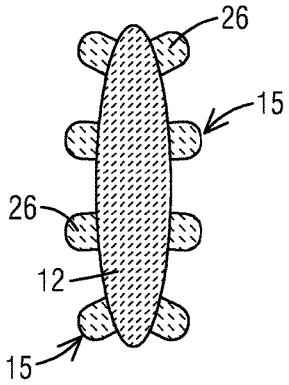
FIGS. 12-13 illustrate sequential steps in a process for forming a component in accordance with another aspect of the present invention.
Figure 13:
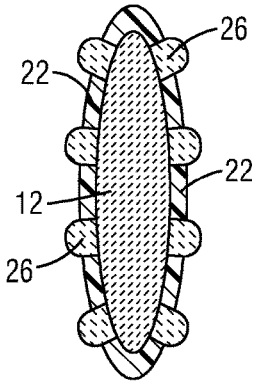

In the above embodiment, the channel defining material 26 was provided about an entirety of a perimeter of the CMC core 12. In accordance with another embodiment, there is provided a process for forming a component comprising depositing the channel defining material 26 in a plurality of spaced apart locations 15 about the outer surface of the CMC core 12 as shown in FIG. 12 to later define a plurality of spaced apart cooling channels 16 (see FIG. 2). To prevent contact of the metal material 40 with the CMC core 12 upon casting of the metal material 40, a protective material 22 may be deposited about at least a portion the CMC core 12 as shown in FIG. 13. The protective material 22 may be applied particularly where no channel forming material 26 is present, thereby preventing contact between the CMC core 12 and the metal shell 18 upon formation of the component 10, 10*a*, 10*b* as described above.

Figure 14:
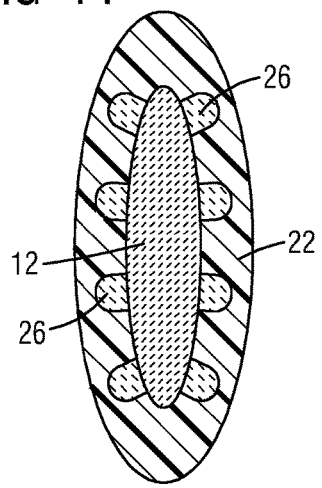
FIG. 14 illustrates another step in a process for forming a component in accordance with another aspect of the present invention.

In a variation, the protective material 22 may be also applied over the channel defining material 26 to define side walls as shown in FIG. 14. In this way, the protective material 22 may form sidewalls for the cooling channels when the cooling channels 16 are formed.

Figure 15:
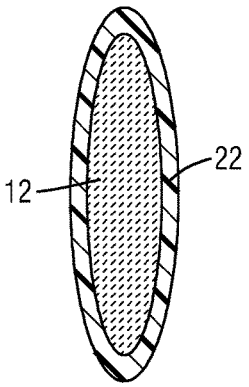
FIGS. 15-17 illustrate sequential steps in a process for forming a component in accordance with yet another aspect of the present invention.
Figure 16:
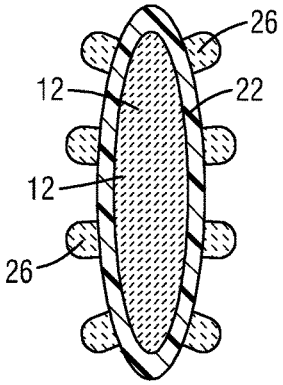
Figure 17:
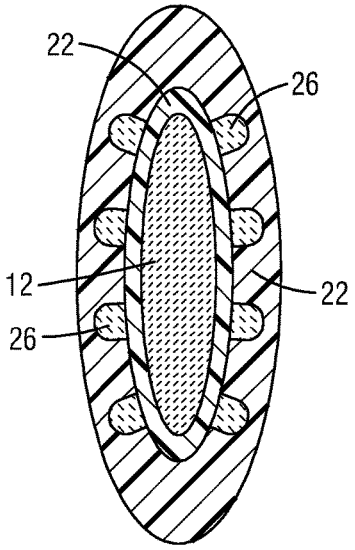

In still another embodiment, as shown in FIGS. 15-17, the protective material 22 may be applied over the CMC core 12 in a first step as shown in FIG. 15. Thereafter, the channel defining material 26 may be applied over the protective material 22 in desired dimension(s) as shown in FIG. 16. In still a further embodiment, although not necessary additional protective material 22 may be applied over the channel defining material 26 as shown in FIG. 17 before the additional manufacturing steps.

After any above process steps of applying the channel defining material 26 and/or the protective material 22, remaining steps of the process 100 may then be carried out as described herein to form a component having a CMC core 12, a metal shell 18, and cooling channels 16 formed therein.

In accordance with another aspect, it may be desirable to secure at least the CMC core 12 in a radial position through the manufacturing process. Accordingly, in an aspect, the processes described herein may further include a step of securing the CMC core to a base member, such as a root section or platform, as the component 10 is formed. Any suitable structure(s) may be utilized for accomplishing the same. In certain aspects, the CMC core 12 may be fixed or anchored in position during the manufacturing process merely by the geometry of the other materials, thereby eliminating the need for mechanical attachment of the CMC core 12 or use of other manufacturing techniques.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A process of forming a component comprising:

providing a cooling channel flow definition at least partially about a core comprising a ceramic matrix composite material;

casting a metal material about the core and the cooling channel flow definition to form an outer metal shell;

applying a protective material in the cooling channel flow definition between an outer perimeter of the core and an inner perimeter of the outer metal shell; and forming an array of cooling channels in the protective material in the cooling channel flow definition.

2. The process of claim 1, wherein the forming a cooling channel flow definition comprises depositing a channel defining material on the core in a pattern corresponding to a desired dimension of the cooling channels.

3. The process of claim 2, wherein the channel defining material comprises a ceramic material selected from the group consisting of alumina, zircon, silica, and mixtures thereof.

4. The process of claim 2, wherein the forming of cooling channels comprises removing an amount of the channel defining material to a degree effective to form the cooling channels.

5. The process of claim 4, wherein the removing is done by a leach process.

6. The process of claim 2, further comprising applying the channel defining material about an entirety of a perimeter of the core.

7. The process of claim 6, further comprising:

forming a wax region about the core and the cooling channel flow definition;

forming an outermost shell about the wax region;

removing the wax region to form a void region; and casting a metal material within the void region to form the component.

8. The process of claim 7, wherein the outermost shell is formed from a ceramic material.

9. A process of forming a component, comprising:

forming a core comprising a ceramic matrix composite material;

defining a cooling channel region about the core;

casting a metal material about the core and the cooling channel region to form an outer metal shell having a coefficient of thermal expansion differing from that of the core;

disposing protective material in the cooling channel region between an outer perimeter of the core and an inner perimeter of the outer metal shell such that inner and outer perimeters of the protective material abut with the outer perimeter of the core and the inner perimeter of the outer metal shell, respectively; and forming an array of cooling channels in the protective material.

10. The processing of claim 9, wherein the protective material is formed as a ring and the array of the cooling channels is ring-shaped.

* * * * *